United States Patent [19]

Ahren

[11] Patent Number: 4,744,188

[45] Date of Patent: May 17, 1988

[54] SUSPENDED ISLAND CEILING SYSTEM

[75] Inventor: Greg M. Ahren, Lakewood, Ohio

[73] Assignee: Donn Incorporated, Westlake, Ohio

[21] Appl. No.: 49,838

[22] Filed: May 15, 1987

[51] Int. Cl.[4] ..... E04B 5/52; E04C 2/38

[52] U.S. Cl. ..... 52/484; 52/488; 52/664

[58] Field of Search ..... 52/144, 145, 484, 475–477, 52/656, 488, 664–667

[56] References Cited

U.S. PATENT DOCUMENTS

| | | | |
|---|---|---|---|
| 3,546,842 | 12/1970 | Blum | 52/484 |
| 3,835,614 | 9/1974 | Downing | 52/475 |
| 3,898,782 | 8/1975 | Donato | 52/488 |
| 3,977,144 | 8/1976 | Jahn | 52/664 |
| 4,189,888 | 2/1980 | Blitzer | 52/484 |
| 4,452,021 | 6/1984 | Anderson | 52/484 |

*Primary Examiner*—James L. Ridgill, Jr.

*Attorney, Agent, or Firm*—Pearne, Gordon, McCoy & Granger

[57] ABSTRACT

A suspended island ceiling system is disclosed in which conventional grid runners are interconnected to produce a rectangular grid. The grid defines openings in which ceiling panels are supported. The grid includes perimeter runners and inner runners which connect at their ends to the perimeter runners at spaced locations along the length of the perimeter runners. Channel-shaped border members are supported on the perimeter runners and provide a finished edge appearance for the island. The border members provide an outer vertically extending base wall and vertically spaced, horizontally extending legs. The upper leg extends over the adjacent perimeter runner and engages the upper surface and one side of the bulb thereof. The lower leg extends along the lower side of the perimeter runners and engages the lower side and at least one side of the flange of the perimeter runners. The ends of the border members are mitered to provide a miter joint and are provided with longitudinally extending openings to receive and conceal corner connectors. The upper leg of the border members is provided with a groove aligned with the adjacent bulb of the perimeter runners through which fasteners may be installed to interconnect the border members and the perimeter runners. At least one of the legs is provided with opposed projections which engage opposite sides of the adjacent portion of the perimeter runner to laterally position the border members in both directions.

12 Claims, 3 Drawing Sheets

SUSPENDED ISLAND CEILING SYSTEM

BACKGROUND OF THE INVENTION

This invention relates generally to suspension ceilings, and more particularly to a novel and improved suspended island ceiling system.

PRIOR ART

Suspension ceilings generally include a metal grid which is suspended from the building structure and extends in an uninterrupted manner throughout an entire area of a building. Very often, lighting fixtures and air handling vent fixtures are incorporated at various locations in the grid, and panels are positioned in the remaining openings to provide a substantially uninterrupted planar ceiling structure. Examples of such systems are illustrated in U.S. Pat. Nos. 4,086,480 and 4,640,064.

It is also known to provide suspension ceiling systems incorporating truncated pyramids or the like at various locations within the ceiling structure. An example of such system is illustrated in U.S. Pat. No. 3,835,614. It is also known to provide separate panel assemblies or islands separately suspended from the building structure to provide special aesthetic effects.

SUMMARY OF THE INVENTION

The present invention provides a novel and improved suspended island ceiling system in which conventional grid runners are assembled in an individual grid and are provided with an attractive finishing border which encloses the edges of the island to provide an attractive suspended island ceiling unit. Such units may be square or rectangular, and can be constructed in various sizes, providing an architect with substantially unlimited aesthetic variations in a ceiling system.

In the illustrated embodiments of this invention, conventional grid runners are assembled to receive conventional lighting fixtures and/or panels. A simple extruded border element is supported by the grid to provide an attractive cover for the edge faces of the island in an economical manner. The border elements are arranged to provide easy assembly on the island without any exposed fastening means.

In one embodiment, the grid is formed of grid runners having a downwardly open channel in the lower surface thereof. Another embodiment incorporates a grid formed of T-shaped grid runners. The border members are interconnected at their ends by a concealed, simple connector insert, and are usually extruded from aluminum, but can also be formed of plastic extrusions or from roll-formed sheet metal.

These and other aspects of this invention are illustrated in the accompanying drawings, and are more fully described in the following specification.

DETAILED DESCRIPTION OF THE DRAWINGS

Figure 1:
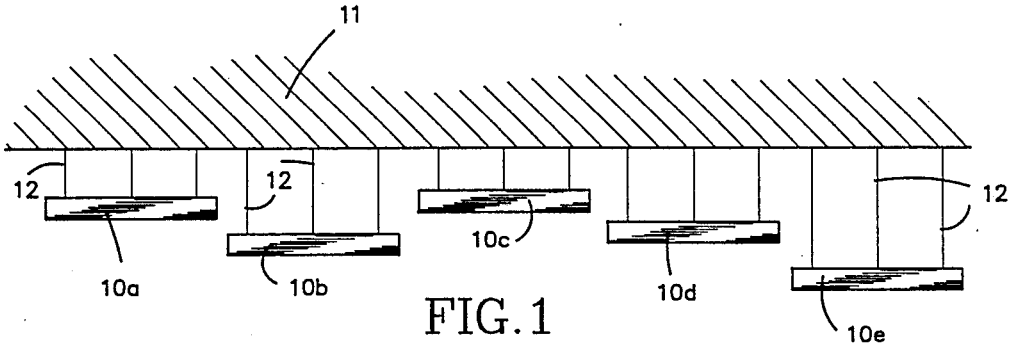
FIG. 1 is a schematic illustration of a suspended island ceiling system in accordance with the present invention, wherein adjacent islands are suspended at different levels to provide one example of an array of islands which may be utilized to produce a particular aesthetic effect.

FIG. 1 schematically illustrates the manner in which suspended ceiling islands 10 may be supported at different heights from the basic building ceiling structure 11 by support wires 12. In such figure, the individual islands 10*a* through 10*e* are suspended at various levels in a random manner. Such arrangement illustrated in FIG. 1 is not intended to represent a particular arrangement which would be employed in a given installation, but is provided merely to illustrate the architectural versatility of island systems in accordance with the present invention.

Further, with the present invention, the islands may be combined with lighting (not illustrated) between adjacent islands, mounted in individual islands, or even indirect lighting in which lighting fixtures are supported by the grid and illuminate in an upward direction.

Still further, the adjacent islands can be laterally spaced from each other, or can be suspended substantially in abutting relationship with some or all of the adjacent islands. With the present invention, an architect is provided with a very versatile design tool with which he can create virtually an endless variety of aesthetic effects.

Figure 2:
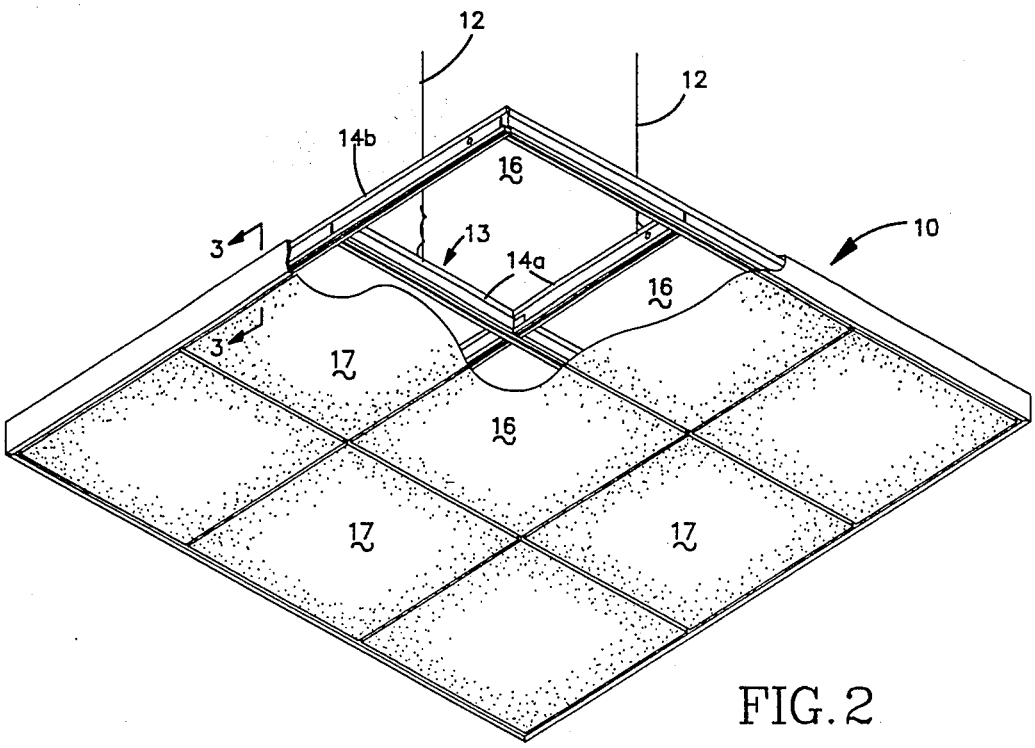
FIG. 2 is a perspective view, partially in section, illustrating the structural detail of one embodiment of this invention formed of runners providing an open lengthwise extending channel in the lower face thereof.

FIG. 2 illustrates the general structural arrangement of a typical island in accordance with this invention. Such island includes a grid 13 formed by an assembly of interconnected runners 14 which cooperate to provide a plurality of rectangular openings 16 in which typical ceiling panels 17 are mounted to form a substantially planar island ceiling surface. Various types of runners may be used to form the assembled grid 15, as discussed in greater detail below. The grid includes inner runners 14*a* and perimeter runners 14*b* which extend around the perimeter of the grid. In accordance with this invention, border trim members 18 are mounted on the perimeter runners 14 to provide a neat and attractive border finish for the island 10.

Figure 5:
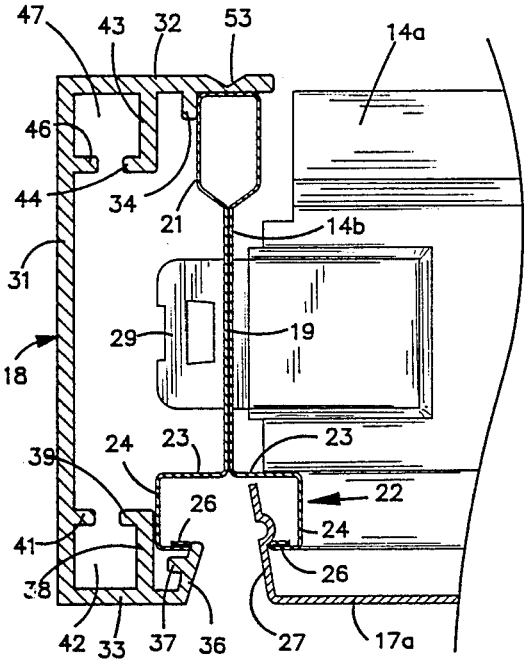
FIG. 5 is a further enlarged, fragmentary section illustrating the structural detail and mounting of the border member at the perimeter of the island unit.

Reference should now be made to FIGS. 2 and 5, which illustrate a first embodiment of this invention. In this embodiment, the inner runners 14*a* and the perimeter runners 14*b* are formed of sheet metal bent to provide a central web 19, a stiffening bulb 21 along the upper edge of the web, and a downwardly opened box-shaped channel 22 along the lower edge of the web 19. The box-shaped channel 22 provides flange means for supporting ceiling panels, and which includes first oppositely extending flange portions 23 extending from the lower edge of the central web 19, downwardly extending, laterally spaced flange portions 24, and inwardly extending flange portions 26. The flange portions 26 are proportioned to provide spaced inner edges 25 so that the channel 24 is open along its lower side.

Figure 3:
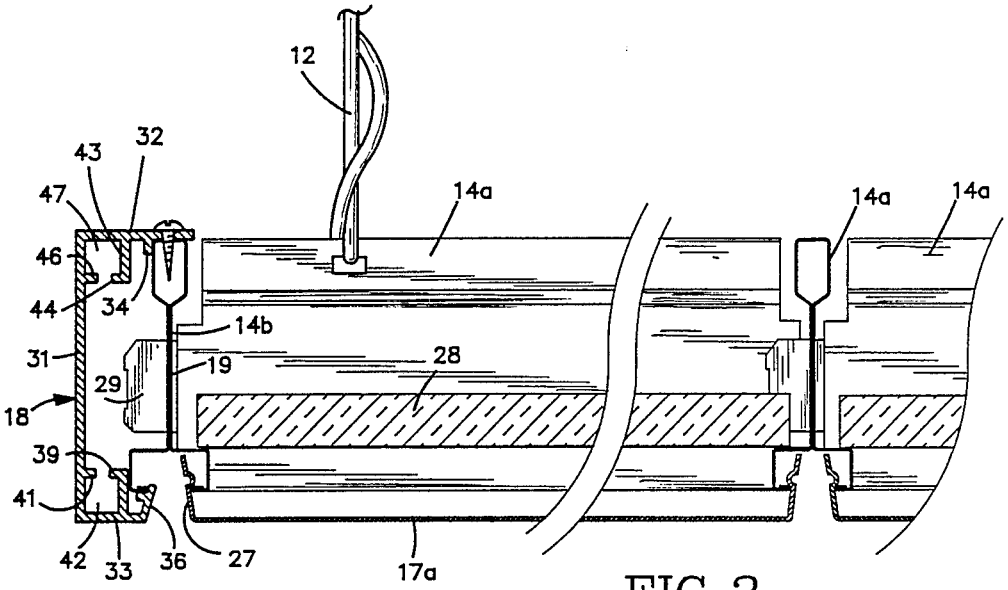
FIG. 3 is a fragmentary section at an enlarged scale, taken along line 3—3 of FIG. 2.

In the embodiment of FIG. 3, a snap-up panel or pan 17*a* is provided with upstanding ribbed edges 27 which extend up into the open channel to mount the panels 17*a* within the openings 16 of the grid. In addition, an acoustical panel 28 is positioned upon the flange portions 23 to define a chamber which functions to deaden sound within the room containing the islands 10. The grid runners 19 and the panels 17*a* and 28 are disclosed and described in greater detail in U.S. Pat. No. 4,640,064, assigned to the assignee of the present invention, and such patent is incorporated herein by reference to provide a detailed description of the structure and advantages of such an acoustical suspended ceiling system.

The various grid runners are provided with end connectors 29 which extend through the central web 19 of the adjacent runners at the intersections thereof in order to interconnect the runners of the assembled grid 13.

If the grid were not provided with a finishing border trim, the outer sides of the perimeter runners 14*b* and the end connectors 29 extending through the web thereof would be visible and would provide a very unsightly edge structure for the island. The border trim members 18 provide a simple, economical, and very attractive border finish for the islands, and enclose the entire outer side of the perimeter runners 14*b*.

The border trim members 18 are generally channel-shaped, providing a vertically extending base wall 31 and vertically spaced, horizontally extending legs 32 and 33 extending from the edges of the base wall 31.

The upper leg 32 is sized to extend inwardly of the island above the bulb 21 of the perimeter runners 14*b* and is provided with a short flange 34 positioned to engage the outer side of the associated bulb 21 when the border member 18 is properly positioned. The lower leg 33 extends inwardly below the outer side of the open channel 22 and is provided with an upstanding flange which extends up into the channel a short distance and is provided with a rib 37 which engages the lower side of the outer flange portion 26. The upstanding flange 36 operates in conjunction with an upstanding wall 38 positioned to engage the adjacent depending portion 24 of the grid to laterally position the lower edge of the border trim member 18 in both directions. This upstanding wall 38 also supports an inturned rib 39 which cooperates with an opposed rib 41 formed in the base wall 31 to define a lower longitudinally extending opening 42 for a connector, described below.

Adjacent to the intersection of the base wall 31 and the upper leg 32, the border member 18 is also formed of a depending wall 43 having a rib 44 which cooperates with an opposed rib 46 to define an upper, longitudinally extending connector opening 47. The border members are sized to enclose the adjacent end connectors with clearance.

Figure 4:
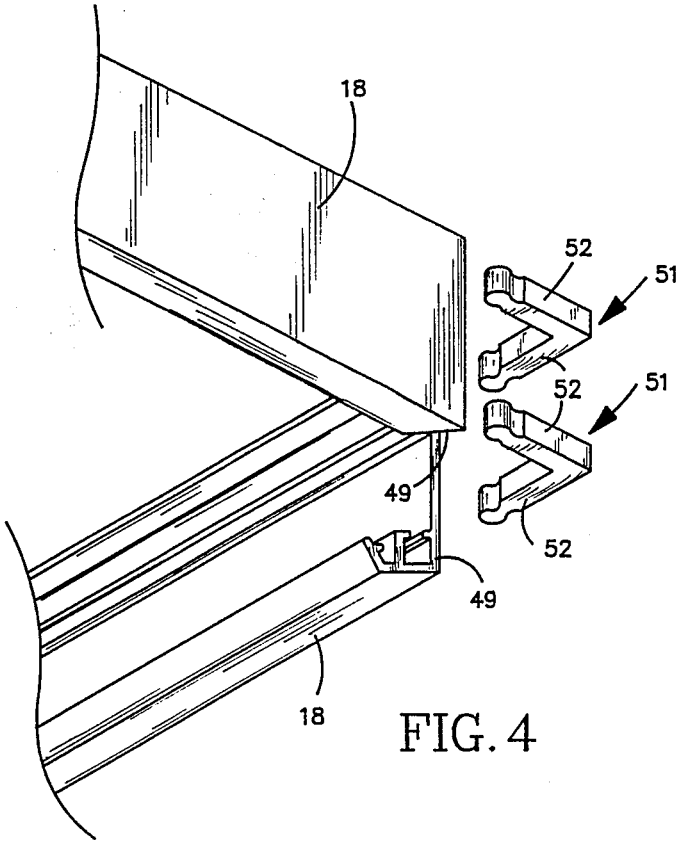
FIG. 4 is an enlarged, exploded view illustrating the end connecting structure for the border members.

FIG. 4 is an exploded view of the corner connection structure for two adjacent, perpendicularly extending border members 18. Each of the border members is provided with a mitered end 48 so that when the connection is completed, a mitered joint is provided at each corner of the island. A pair of corner connectors 51 are provided to connect the adjacent ends of the border members 18. Each of the connectors is provided with perpendicularly extending legs 52 proportioned to extend into the associated openings 42 and 47 with a tight fit. These connectors 51 ensure that the ends of the border members 18 are held in perfect alignment when the border members are assembled on the island.

The upper legs 32 of the border members 18 are provided with a shallow groove 53 aligned with the center of the adjacent perimeter runner bulb 21 when the border members are properly installed on the grid. Such shallow groove, because of its location in the center of the adjacent bulb 21, provides a visual indication to the installer of the location where a self-drilling or tapping screw 54 can be placed to provide a more secure connection between the border members 18 and the grid. Such grooves, however, because they are located in the upper leg of the border members, are not visible. In fact, the mounting of the border members around the perimeter of the grid provides a completely finished surface in which there are no exposed visible mounting connectors. Preferably, the lower leg 33 is positioned to be substantially coplanar with the bottom of the panel 17*a*, and cooperates with the adjacent panel to provide an upwardly open space similar to the exposed spaces between adjacent panels in the remainder of the island.

FIG. 5 illustrates a variation of the island structure which is identical to the island structure of FIG. 3 except that an acoustical panel 28 is not provided. However, the visual appearance of the island having the structure of FIG. 5 is identical to the visual appearance of the island of FIG. 3.

Figure 6:
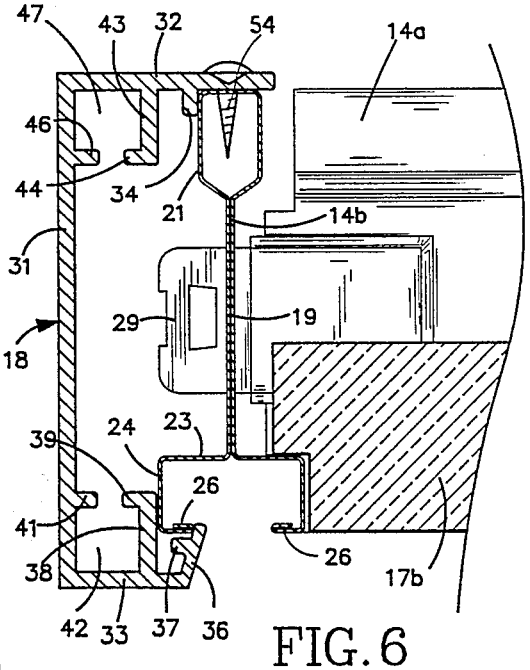
FIG. 6 is an enlarged, fragmentary section similar to FIG. 5, but illustrating an island unit in which a different form of ceiling panel is supported on the grid runners.

FIG. 6 discloses a variation of the embodiment of FIGS. 3 through 5 in which the grid runners 14*a* and 14*b* are identical to the grid runners previously described and the border elements 18 are identical to the border elements previously described. In this variation, however, a panel 17*b* is installed in the grid and is provided with a rabbeted edge to provide a horizontal support surface 61 that engages the adjacent flange portion 23 to support the panel within the grid. In this variation, the lower surface of the panel is aligned with the adjacent inwardly extending flange portion 26 so that the lower leg 33 of the border member 18 is located below the plane of the exposed surface of the panel 17*b*.

Figure 7:
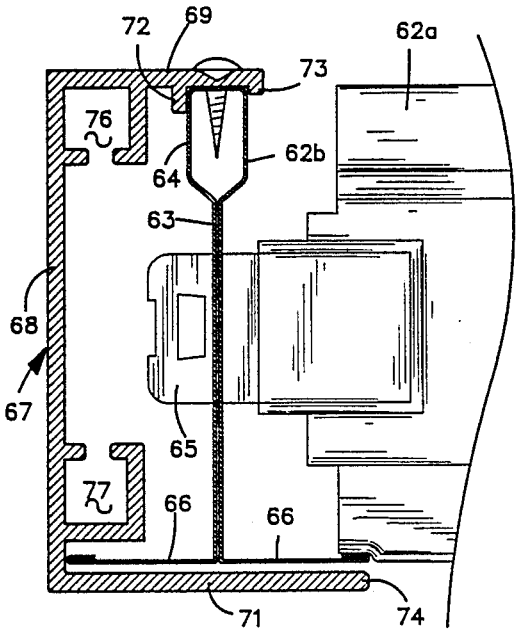
FIG. 7 is an enlarged, fragmentary view similar to FIGS. 5 and 6, but illustrating a second embodiment of this invention incorporating a conventional T-shaped grid runner.

FIG. 7 illustrates a second embodiment in which the grid is formed of conventional grid tees. In this embodiment, the interior runners 62*a* and the perimeter runners 62*b* are again provided with a central web 63 having a stiffening bulb 64 along the upper edge and oppositely extending flanges 66 extending from the lower edge of the central web. Here again, such grid tees are of conventional cross section known to those skilled in the art and are provided with end connectors 67 which extend through the webs of the adjacent tee at the intersections in the grid.

In this embodiment, the border trim members 67 are again formed with a channel shape providing an outer base wall 68 and upper and lower, spaced, horizontally extending legs 69 and 71, respectively. Again, the upper legs 69 are provided with a depending flange 72 engaging the outer side of the adjacent bulb, and extend over the bulb to support the border trim members on the perimeter grid tees 62*b*. In this embodiment, however, it is preferable to provide a depending rib 73 which engages the inner side of the adjacent bulb and cooperates with the flange 72 to laterally position the border trim member 67. Further, in this embodiment the lower leg is sized and positioned to extend along the flanges 66 and terminates at an inner edge 74 aligned with the inner edge of the flange 66. Here again, the border trim members 67 are provided with upper and lower openings 76 and 77 sized and positioned to receive corner connectors 51 to ensure that the corners provided at the ends of the border members are properly aligned and provide a neat, mitered joint.

In each of the embodiments, a structure is provided along either the upper leg or the lower leg of the border member to embrace an associated part of the grid runners or tees to laterally position the border members in both directions. In the embodiment of FIGS. 3, 5, and 6, such lateral positioning is accomplished along the adjacent outer flange portion 26, and in the embodiment of FIG. 7, such lateral positioning is provided by the flange 72 and rib 73, which embrace the opposite sides of the bulb 64 of the perimeter tee **62*b***. Therefore, a lateral positioning connection is provided along the entire length of each of the border members independent of screws and proper alignment is maintained.

The border members of this invention are preferably extruded from metal or plastic material and are provided with an attractive surface finish. Preferably, the proportions are arranged so that the border members can be easily snapped into position on the grid without any visible distortion of either the perimeter grid elements or the border members. If the border members are formed of extruded metal which is relatively rigid, the clearances and proportions are sized to allow easy installation, and may require temporary distortion of the runners. If the border members are extruded from plastic material, such material is preferably selected to be substantially rigid but to permit some temporary deformation as the border member is snapped into position. In such instances in which the border members are formed of plastic material, the clearances may be reduced so that a snug fit is provided in an installed system.

With this invention, a low cost, easily installed, aesthetically pleasing island structure is provided having a very attractive finished border appearance while using standard grids and panels normally used in typical, full suspended ceiling systems.

Although the preferred embodiments of this invention have been shown and described, it should be understood that various modifications and rearrangements of the parts may be resorted to without departing from the scope of the invention as disclosed and claimed herein.

What is claimed is:

1. A suspension ceiling island structure comprising a grid of interconnected runners cooperating to define a rectangular island assembly and defining within said island assembly a plurality of rectangular openings, panels supported within said openings by said grid, said grid including perimeter runners extending along the edges of said grid, said runners providing a central web, a stiffening bulb along the upper side of said web, an oppositely extending panel supporting flange means along the lower side of said web, said perimeter runners being interconnected at longitudinally spaced locations to perpendicularly extending inner runners, and generally channel-shaped border trim members mounted on said perimeter runners enclosing the perimeter of said grid and providing a finished border on said island, said border members providing an outer base wall and a pair of vertically spaced generally horizontally extending legs joined to said base wall, the upper of said legs engaging the upper surface and one side of the bulb of an associated perimeter runner, the lower of said legs engaging the lower surface and one side of said flange means of an associated perimeter runner, said runners also providing corner openings, and corner connectors fitting into said corner openings at adjacent ends of said border members and operating to interconnect said border members at said corners.

2. A suspension ceiling island structure as set forth in claim 1, wherein said upper legs of said border members provide a longitudinal groove aligned with said bulb, and fasteners extend through said groove into the adjacent of said bulbs of said perimeter runners to connect said border members to said grid.

3. A suspension ceiling island structure as set forth in claim 1, wherein said border members provide mitered ends engaging adjacent ends of adjacent border members with a mitered joint, and said corner connectors are concealed within said border members.

4. A suspension ceiling island structure as set forth in claim 3, wherein at least one of said legs provides spaced surfaces engaging inner and outer sides of said adjacent perimeter runner to laterally position said border members with respect to said adjacent perimeter runner in both directions.

5. A suspension ceiling island structure as set forth in claim 4, wherein said border members are snapped into position on said adjacent perimeter runner without producing visible distortion of said border members or perimeter runners.

6. A suspension ceiling island structure as set forth in claim 5, wherein said border members are extrusions and said openings extend longitudinally of said border members, said connectors being substantially L-shaped and providing a leg extending into an opening in each of said border members at said corners.

7. A suspension ceiling island structure as set forth in claim 5, wherein said border members are non-metallic extrusions formed of substantially rigid material and which is deflectable when said border members are snapped into position on said adjacent perimeter runners, said border members being dimensioned to grip said associated perimeter runners and prevent relative movement therebetween.

8. A suspension ceiling island structure comprising a grid of interconnected runners cooperating to define a rectangular island assembly and defining within said island assembly a plurality of rectangular openings, panels supported within said openings by said grid, said grid including inner runners and perimeter runners extending along the edges of said grid, said runners providing a central web, a stiffening bulb along the upper side of said web, an oppositely extending panel supporting means along the lower side of said web, said perimeter runners being interconnected at longitudinally spaced locations to perpendicularly extending inner runners by end connections extending outwardly through the webs of said perimeter runners, and generally channel-shaped border trim members mounted on said perimeter runners enclosing the perimeter of said grid and providing a finished border on said island, said border members providing an outer base wall extending generally vertically and a pair of vertically spaced, generally horizontally extending legs joined to said base wall, the upper of said legs engaging the upper surface and one side of said bulb of an associated perimeter runner, the lower of said legs engaging the lower surface and one side of said flange means of said associated perimeter runner, said border members also providing longitudinally extending corner openings and mitered ends engaging adjacent border members with a miter joint, and L-shaped corner connectors fitting into said corner openings of adjacent ends of said border members with a tight fit operating to interconnect said border members at said corners, said border members being sized to enclose said end connectors extending through said webs of said perimeter runners with clearance.

9. A suspension ceiling island structure as set forth in claim 8, wherein said border members provide opposed surfaces on at least one of said legs which engage opposite sides of the adjacent portion of the adjacent perimeter runner and laterally position said border members in both directions.

10. A suspension ceiling island structure as set forth in claim 8, wherein said upper legs of said border members provide a lengthwise groove aligned with the adjacent bulb of said perimeter runners, and fasteners extending through said groove into said adjacent bulb secure said border members to said grid.

11. A suspension ceiling island structure as set forth in claim 8, wherein said flange means defines a box-shaped channel along the lower side of said runners which is open along the lower surface thereof, and said lower legs of said border members project up into said opening in said lower surface of said boxlike channel.

12. A suspension ceiling island structure as set forth in claim 11, wherein said panels provide a central planar portion and upstanding flanges projecting upwardly into said opening in said boxlike channel, said planar portion of said panels being substantially coplanar with said lower leg of said border members.

* * * * *